United States Patent [19]

Vogel

[11] 4,117,698

[45] Oct. 3, 1978

[54] REFRIGERATED DISPLAY

[75] Inventor: Robert E. Vogel, Marshall, Mich.

[73] Assignee: Kysor Industrial Corporation, Cadillac, Mich.

[21] Appl. No.: 810,973

[22] Filed: Jun. 29, 1977

[51] Int. Cl.[2] ..... A47F 3/04; F25D 11/00

[52] U.S. Cl. ..... 62/256; 312/116

[58] Field of Search ..... 62/246, 255, 256, 151, 62/158; 160/243, 260; 312/116; 49/507

[56] References Cited

U.S. PATENT DOCUMENTS

| | | | |
|---|---|---|---|
| 3,186,185 | 6/1965 | Bently et al. | 62/256 |
| 3,241,899 | 3/1966 | Donker | 62/255 |
| 3,403,525 | 10/1968 | Beckwith et al. | 62/256 |
| 3,465,536 | 9/1969 | Vogel et al. | 62/158 |
| 3,496,732 | 2/1970 | Vogel et al. | 62/158 |

*Primary Examiner*—Lloyd L. King

*Attorney, Agent, or Firm*—Price, Heneveld, Huizenga & Cooper

[57] ABSTRACT

A multi-curtain, open front refrigerated display case having unique energy saving capacity as a result of the combination of an attached, retractable night curtain specially located between the refrigerated air curtain and the adjacent warmer guard curtain and upon which frost and ice form during closed store hours, with a reverse air defrost flow system that melts the front and ice from the curtain surface prior to retraction thereof at store opening time.

10 Claims, 6 Drawing Figures

REFRIGERATED DISPLAY

BACKGROUND OF THE INVENTION

This invention relates to multiple curtain, open front refrigerated display cases.

The rising cost of energy has recently caused concerned review of the economics and energy usage of open front refrigerated display cases. These have replaced a substantial market share of the glass door reach-ins or chest-type cabinets because of the several advantages including potentially higher sales capacity, greater convenience, and more effective display of product. While the relative energy loss from open front cases is greater than from the closed door-type during shopping hours, the difference is not as large as might be anticipated due to the fact that the door-type are constantly opened and closed. However, relative energy loss during the closed store hours is significant. Actually, this factor was recognized years ago and as a result, night covers as set forth in U.S. Pat. Nos. 3,465,536 and 3,496,732 were devised in efforts to cover open front display cabinets during such hours. These night covers constituted removable, heavily insulated structures which are sealed tightly to the cabinet to prevent leaks from between them. The insulation was provided to prevent condensation of the structure tending to interfere with the system and even freeze the cover in place. Any air leaks between the structure and the display case, even tiny ones, were found to cause significant frost accumulation at that area, to interfere functionally with the equipment, potentially freeze the cover in place, and generally present a frost problem. These covers unfortunately were large, bulky and cumbersome, requiring special daytime storage, evening retrieval, and protection against damage or distortion which would prevent the necessary tight fitting characteristics. These factors together proved such a problem that the covers were never really accepted as practical.

Another more recent type of night cover is that set forth in U.S. Pat. No. 3,241,899. This unit is retractable, being mounted directly on the display case itself. Such covers are presently marketed. When used to cover dairy case structures wherein the temperatures are above freezing, these covers do cause a considerable power savings during non-shopping hours. Therefore, the assignee herein, a manufacturer of diary-type cases recommends the usage of such covers for these cases.

In comparison with the dairy-type display cases with temperatures above the freezing point, however, the frozen food open front display cases which are below freezing temperatures have significantly greater energy loss. And, sub-zero , open front display cases for ice cream and the like have the greatest energy loss. These frozen food and ice cream open front display cases are today almost totally of the multiple curtain-type for maximum efficiency. Yet, the roll-up curtain-type cover has really not been particularly advantageous for these high energy cases. Firstly, there is a problem as to where to place it. The manufacturer of these curtains presently advises placement of the curtain over the multiple of air curtains, i.e. encompassing the guard curtains too. Although the manufacturer recommends this, experimentation by the assignee herein, a manufacturer of display cases, has shown that placement of the curtain in this fashion on low temperature cases does not result in any significant savings of energy. If the curtain were to be placed immediately over the inner refrigerated air curtain, i.e. and not over the other curtains of air, frost formation and freezing would occur on and about the curtain. This is totally unacceptable to the store manager. Thus, the assignee does not presently recommend use of the curtain to purchasers of low temperature (i.e. frozen food and ice cream) open front multiple curtain display cases.

As is known, until recently the energy loss from multiple curtain open front refrigerated display cases has simply been tolerated. Presently, with rapidly rising energy costs and a general desire to conserve energy, the sale of these open front display cases is significantly declining, being replaced by sales of the older door-type, even in spite of their significant sales disadvantages.

SUMMARY OF THE INVENTION

The inventor herein has discovered that by combining certain display case features in a particular fashion, the low temperature multiple curtain open front refrigerated display case can be operated at significant cost savings, and in fact at a cost comparable to and often lower than the cost of operating the closed door-type display. Energy savings of 25% to 30% are experienced in comparison to the same cases without the invention. A retracting night curtain, specially placed with respect to the multiple air curtain, is used in combination with a controlled reverse flow air defrost system. By so doing, even though frost is formed on the curtain from condensate, it merely serves as added thermal insulation during the closed store hours, and then is dissipated in the morning by the reverse flow defrost air before curtain retraction, to enable uninhibited curtain retraction. Thus, it presents no problem to proper storage of the curtain or to operation of the case.

DESCRIPTION OF THE PREFERRED EMBODIMENT

Figure 1:
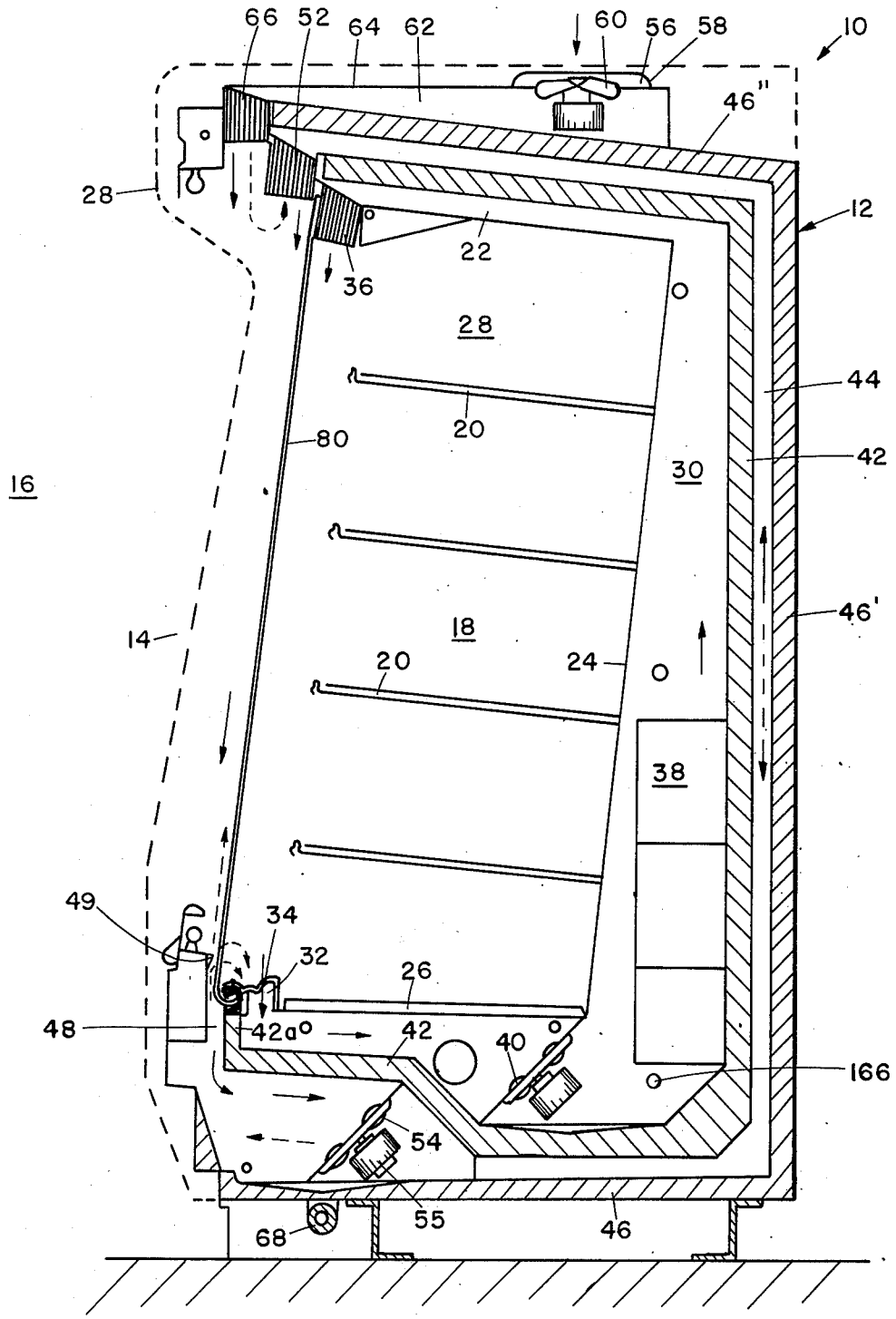
FIG. 1 is a side elevational sectional view of the inventive combination, showing the night curtain component mounted in a first fashion.
Figure 5:
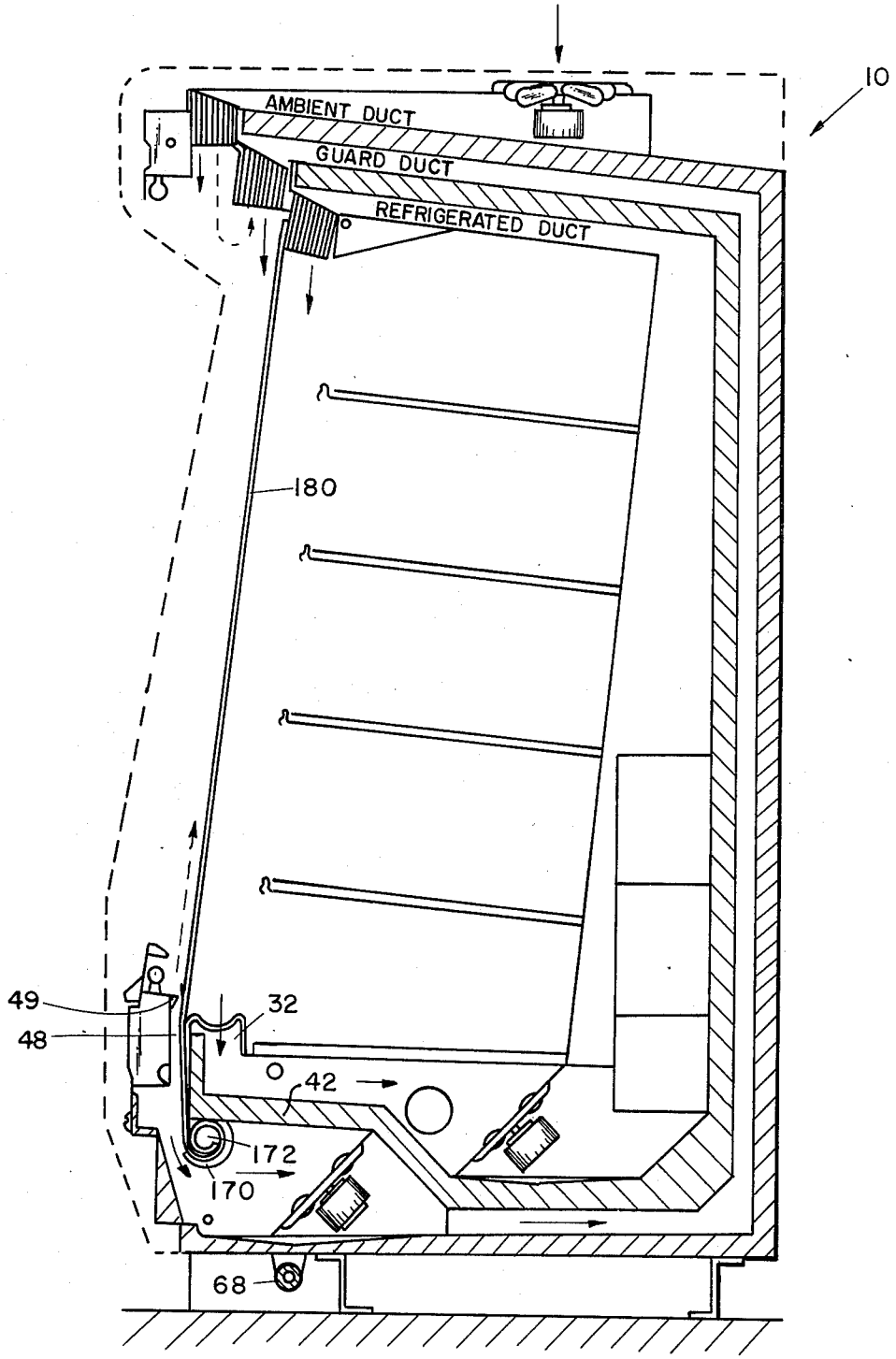
FIG. 5 is a side elevational sectional view of the inventive combination, showing the night curtain mounted in a second fashion.

Firstly, although it will be noted that two slightly different variations of the apparatus are generally depicted at FIGS. 1 and 5, the equipment shown in these two figures is basically the same except for the mounting of and material of the retractable night curtain.

Referring specifically to FIG. 1, the open front multiple curtain refrigerated display case 10 constitutes a housing assembly 12 having an access opening 14 over the front thereof, from the ambient air space 16 about the cabinet to the food storage and display case 18 in the cabinet. This structure is normally placed in a grocery store or supermarket, with display space 18 being divided into sections by a plurality of vertically spaced generally horizontal shelves 20. Display space 18 is confined on the top by an upper panel or ceiling 22, a rear panel or wall 24 to which the shelves are attached, a bottom panel 26 which also serves as a support shelf, and a pair of end walls 28.

Extending around and adjacent the bottom 26, back 24 and top 22 of display area or space 18 is an inner, refrigerated air flow passage or conduit 30 extending substantially along the length of the case. Passage 30 has an elongated upwardly oriented air flow inlet 32 extending along the lower edge of access opening 14, and normally covered by a perforate grill 34 which may be electrically heated to prevent frost formation. Along the upper edge of the access opening 14, opposite the inlet 32, is an elongated air flow outlet nozzle 36 normally containing downwardly oriented air directing means such as honeycomb as depicted. This outlet nozzle is the innermost of a plurality, preferably three in number, serving to discharge refrigerated air down across the open front of the display space to the inlet 32.

Located in passage 30, preferably along the lower rear portion thereof, as in the space behind the downwardly forwardly sloping back panel 24, is evaporator coil means 38 containing the usual tubes and fins, and extending generally along the length of the back panel such that air flow through the innermost recirculating passage of the display must flow through the coil during normal operation. This evaporator refrigeration equipment is operably connected with conventional condensing equipment external of the display case in usual fashion, e.g. on the roof of the store, in the rear of the store or otherwise as is normally done.

Also within passage 30 preferably at the bottom portion of the display case, is a plurality of motor operated fans 40 spaced lengthwise along the display case and acting as air propulsion means to constantly circulate air drawn into inlet 32, past these fans 40, through passage 30, including coils 38, out outlet 36, and down across the open front 14 of the display case, i.e. in counterclockwise fashion in the form depicted in FIG. 1 as represented by the solid arrows. Thus, the refrigerated air is recirculated in this fashion. Passage 30 is basically defined between the noted panels 26, 24 and 22 forming one side thereof, and a spaced panel or partition 42 extending around the bottom, back and top of the case to form the other side of the passage. The refrigerated air flowing through passage 30 not only forms an enclosing air curtain in the open front of the case, but also a protective envelope around the case. Partition 42 not only forms the outer wall of inner passage 30, but also forms the inner wall of a second adjacent passage 44 which extends around the bottom, back and top of the case outwardly of passage 30, relative to display space 18. The outer wall of passage 44 is formed by bottom panel 46 and back and top panel 46' and 46''. Passage 44 includes an elongated inlet 48 adjacent to and outwardly of inlet 32, i.e. along the lower edge of the display opening 14. Opposite this upwardly opening inlet 48 and adjacent the outlet nozzle 36 at the top edge of the display opening 14 is another downwardly oriented elongated outlet nozzle 52 from passageway 44 including air directing means such as honeycomb as depicted. During normal operation, air is circulated through passage 44 by a plurality of motor operated fans 54 preferably in the bottom of the case. These fans propel air from inlet 48 through passage 44, enveloping the refrigerated air passage 30, and out nozzle 52, to form a protective guard curtain of air contiguous with and flowing in the same direction with the refrigerated inner air curtain flowing across the open front case. This guard curtain returns to outlet 48 for continuous recirculation, all as shown by the solid arrows in FIG. 1. Typically during normal operation, the temperature of this recirculated guard air through passage 44 is at a temperature somewhat higher than the temperature of the inner refrigerated air curtain, but below ambient temperature. It is cooled somewhat by its association with the inner air curtain. Fans 54 are spaced longitudinally along the passage to obtain relatively uniform flow over the length of this passage.

A third curtain of air at ambient temperature is preferably also employed. This curtain is not recirculated about the case, but rather entering the case at the time and exiting in front of the rub rail into the aisle. The ambient air for this third curtain enters the case through a plurality of top inlets 56 covered by perforate grids 58 or the like, the air being drawn down in by a plurality of motor operated fans 60 spaced longitudinally along the top of the case length. The air is then propelled downwardly through elongated passage 62 between panels 46'' and top panel 64 to a third elongated outlet nozzle 66 along the top edge of the case, and directed downwardly across the open front of the case outwardly of the inner two nozzles relative to the display space 18. Nozzle 66 is adjacent nozzle 52 and preferably at a small acute angle relative thereto, with nozzle 52 also preferably being at a relatively small acute angle relative to nozzle 36, all in conventional fashion. The air flow normally flowing through nozzle 66 is as indicated by the solid arrows, flowing across the open front or access opening contiguous with the curtain from nozzle 52, and, at the lower edge of the access opening separating from the intermediate air guard curtain and flowing out over the rub rail into the aisle area of the store for customer comfort as well as adding inertia to the total air curtain flow. The above features are of conventional construction, all being previously known, with the novel features being incorporated into the assembly in combination as set forth below.

The motors 55 that operate the guard curtain fans 54 are electrically reversible, as are the fans therefor, to enable air to be forced in the opposite direction to passage 44 from that shown in the solid arrows, i.e. in the direction indicated by the dashed arrows during defrost operation. This reverse flow defrost concept is basically set forth in U.S. Patent Application Ser. No. 686,895 filed May 17, 1976, now U.S. Pat. No. 4,026,121. Thus, during defrost, the air is drawn into the intermediate guard nozzle 52, both from the outlet nozzle 66 and also from the ambient atmosphere in front of the case, is circulated around the display, and is discharged up through the opening 48. During normal defrost, the night curtain 80 (to be described) is not extended as shown in FIG. 1, such that the air leaving opening 48 can be drawn down into opening 32, assisted by deflector 49 at the end of opening 48.

Figure 2:
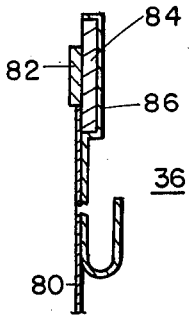
FIG. 2 is a fragmentary enlarged side elevational sectional view of the upper edge of the night curtain engaged with the nozzle divider between the inner and first guard curtain outlet nozzles.
Figure 4:
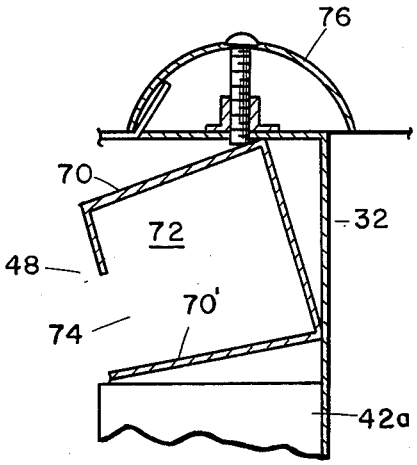
FIG. 4 is a side elevational sectional enlarged view of the retainer assembly of the night curtain in FIG. 1.
Figure 3:
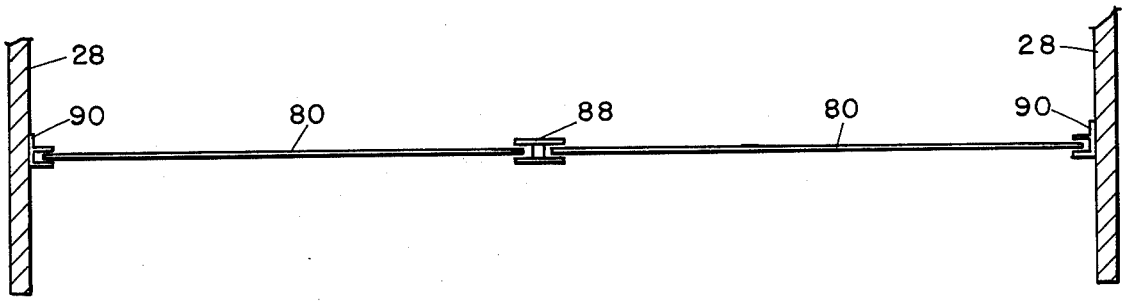
FIG. 3 is a plan sectional view of the front of the display case in FIG. 1, showing a pair of the curtains.

The panel or wall 42 that separates the conduits 30 and 44 along the bottom of the display case has an upwardly protruding terminal portion **42*a* between the openings 32 and 48. At this terminal portion is mounted an elongated housing 70 (FIG. 4) defining an internal chamber 72 with an elongated outlet 74 on the front thereof. This housing is immediately below the divider element 76, typically heated, between these two openings 32 and 48. Within this housing is helically coiled the flexible, retractable roll-up night curtain 80, having one end secured into the housing and having fastening means on the other free end. This fastening means is preferably a magnetically responsive metallic element 82 secured to and forming part of the upper edge of the retractable curtain 80 (FIG. 2) so as to be securable to a magnetic element 84 preferably recessed into the metallic retainer housing 86 of the inner honeycomb nozzle 36. Alternatively the magnetic element can be on the curtain and the magnetically responsive element on the nozzle area. Thus, the night curtain can be pulled upwardly by its upper edge from a retracted lower coiled position within housing 70 to an upwardly extended position over the open front of the case, between the nozzles 52 and 36 at the top, and the openings 48 and 32 at the bottom so as to separate the refrigerated air curtain from the air flowing through the guard components and close off the display space and recirculated refrigerated air curtain with its nozzle and return inlet. As depicted in FIG. 3, preferably the open face of a display case, e.g. of about eight feet in length, employs two of such flexible night curtains instead of one, so that each can be more effectively controlled against tendencies to curl or curve outwardly or inwardly relative to the display space. Also, it has been found preferably to employ side channel guides for the edges of the curtains (FIG. 3). These side channels can be formed by suitable single upright channels 90 mounted on the end panels 28 of the display case, supplemented by a central double channel element 88 extending from the top to the bottom of the open front, this double channel element having individual channels which face and cooperate with the single side channel members. In the form of the apparatus depicted in FIG. 1, with the retainer housing positioned at the top edge of divider member 42***a*, it may sometimes be necessary to employ an electrical heater element within housing 70 to assure nonfreezing of condensate which flows down the surface of curtain 80 into the vicinity of the housing. The downwardly forwardly sloping lower edge 70' (FIG. 4) of the housing does assist in preventing condensate from accumulating in the housing, however.

A second version of the apparatus wherein the assembly 10 is basically the same as that explained above relative to FIG. 1 has been devised as set forth in FIG. 5, with the housing 170 of the flexible curtain being mounted on the underside of the front portion of horizontal panel 42. This location allows a larger housing to be employed without interfering with air flow through the passages 48 and 32, and also does not require any electrical heat to prevent the system from freezing since the housing is not adjacent to any of the low temperature refrigerated air flowing through passage 32. By enabling housing 170 to be larger at this location, the material forming the flexible night curtain 180 can be thicker. Therefore, for example, a foam material, e.g. foam rubber, having an impervious surface can be employed. A suitable material could for example be that known as "RUBATEX", being about ⅛ inch thick. This rubber effectuates insulation for the curtain which, although not essential to the invention, can assist in preventing loss of cold air from the display case when the curtain is drawn. When employing the structure in FIG. 1 on the other hand, the curtain should be of a thinner material, e.g. about 0.005 to 0.010 inch thickness, as of polyester or the equivalent, of the type set forth for example in U.S. Pat. No. 3,241,899 which is formed with an inherent memory to cause it to return to its lowered coiled up position or condition when disconnected from the honeycomb nozzle. The heavier material which can be accommodated in the housing located as in FIG. 5 preferably employs a rotationally biased winding cylindrical core 172 comparable to that of a window shade to assure effective return of the flexible night curtain 180 to its retained condition.

Figure 6:
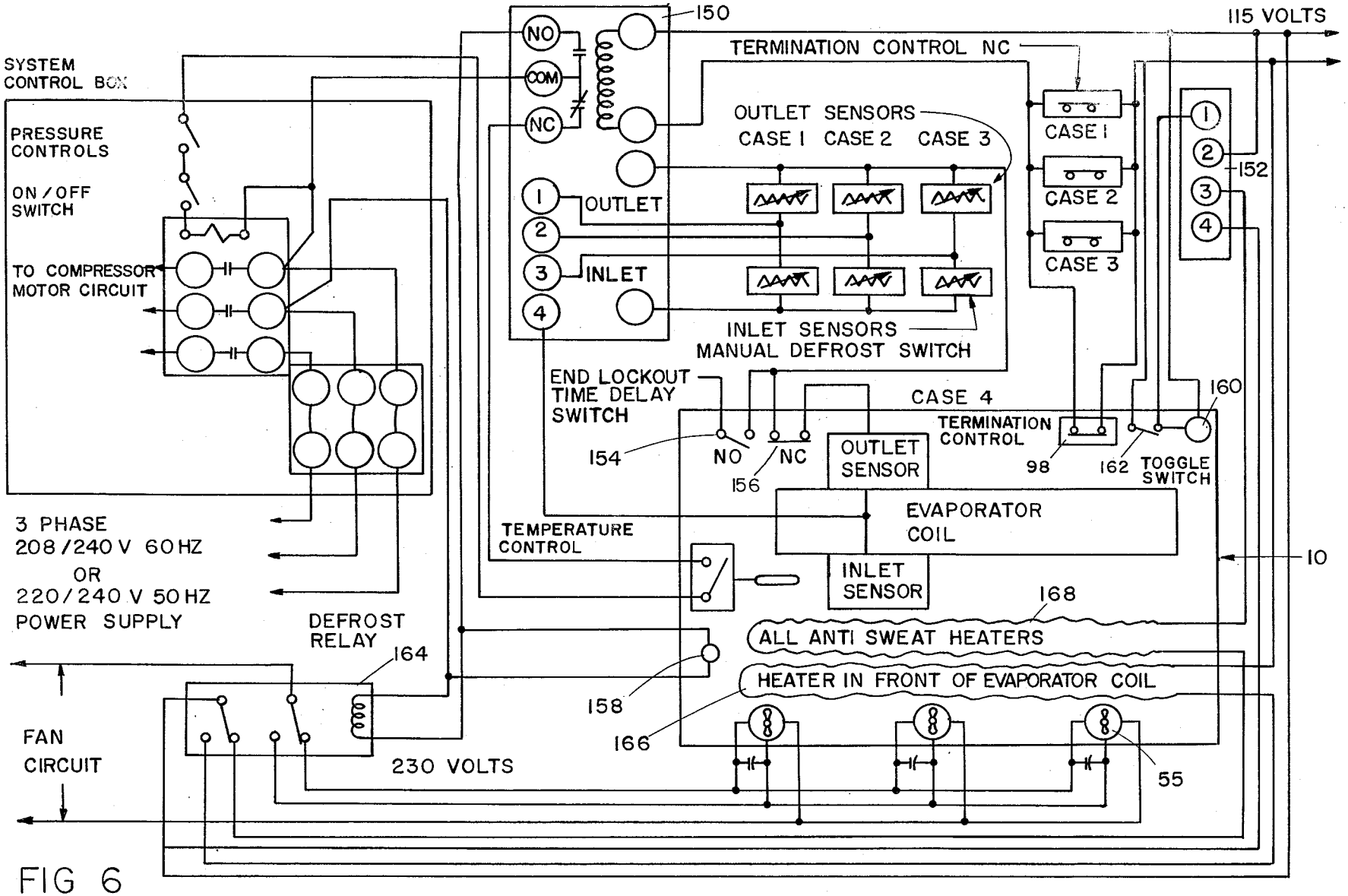
FIG. 6 is a schematic electrical diagram for the apparatus.

It is the combination of the reverse flow air defrost with the flexible night curtain in this particular location which achieves the unique advantages and energy savings of this invention. As noted previously, it would be normally undesirable to have a flexible curtain of this type extended between the refrigerated nozzle 36 and the adjacent guard curtain because of the fact that excessive frost and ice tend to form on the curtain when it is drawn. This occurs at any areas where the cold air from the interior can exit to the external surface of the curtain. Such frost formation does in fact form on the night curtain in the inventive combination. By controlling the reverse flow air defrost such that the reverse flow occurs for a predetermined period of time prior to retraction of the curtain from its covering position, the ice is melted off and the condensate dried to allow the night curtain to be neatly recoiled back into its lower, hidden retainer. Water from the melted ice is disposed of down drain 68. Activation of the defrost reverse flow can be manually achieved by store personnel a period of time prior to scheduled opening of the store and access to the display space. The length of this period of time will vary somewhat depending upon the ambient store conditions including temperature and humidity, temperature within the low temperature display case, and other such factors, but typically will be between 20 minutes and 1 hour. A preferred circuit for the apparatus is depicted in FIG. 6.

The circuit is shown in relation to four display cabinets or cases. In this illustrative showing, the fourth case is display cabinet 10 of the other drawings. The defrost controls shown include a demand defrost control 150. That is, defrost occurs when the sensor at the cabinet indicates it needs defrost, as detected by a predetermined difference in temperature between the inlet air to the coil and the outlet air from the coil. The control is marketed by Minneapolis Honeywell Co. as "Honeywell Demand Defrost Control CR70A". A sensor for the control may be placed in each of the multiple of cabinets to cause any one of such to trigger the defrost operation. In such an arrangement, switches 154 and 156, and light 158 would be only on the cabinet on which control 150 is mounted, while each cabinet would have a control 152, switch 162 and light 160. This demand control is preferable to a timer-operated defrost because the coil does not need defrost when the night cover is extended upwardly.

The control circuit also preferably includes control 152 that will shut down the anti-sweat heaters 168 on the cabinet during defrost, and optionally divert the power for such to a heater 166 upstream of the coil for more rapid defrost. Heater 166 need not be employed on all cabinets, depending on the defrost rapidity needed or desired. Control 152 may be, for example, a "Honeywell Anti-Sweat Control H-409A". Also incorporated into the circuit are end lock-out time delay manual switch 154, manual defrost activation switch 156, indicator light 158 preferably red, indicator light 160 preferably yellow, toggle switch 162, and double pole, double throw defrost relay 164.

The sequence of operations of the apparatus during a 24 hour period is as follows:

A. At the end of the store shopping period, night covers 80 are pulled out from their housing 70 and its top metal edging 82 is placed on magnetic strip 84.

B. Toggle switch 162 is turned to the "Off" position turning out yellow indicating light 162. This switch turns off all the anit-sweat heat in the cabinet, as it is not required while the night covers 80 are in place. The yellow indicator light 160 tells what mode the anti-sweat heaters are in, and also if "On" when the night covers are up, serves as a reminder that the heaters should be shut "Off".

C. With the night cover curtain in place the moisture in the ambient air cannot form frost on the evaporator coil so defrosting of the evaporator coil is not required. The demand defrost control 150 will initiate a defrost only when required, so no defrosts will occur while the cover is in place.

D. While the night cover is in place, its temperature falls below the dew point so that condensation, frost and ice form on it, acting as an insulator.

E. An hour or two before the store is open for business all cabinets must be put through a defrost period. Since these cabinets employ reverse flow air defrost, this can be done without increasing the electrical demand charge. To put the cabinet into a manually activated defrost, the two push button switches 154 and 156 are depressed momentarily. This will put the cabinet into the defrost mode and the red indicator light 158 will come on. Since the cover or curtain is between openings 48 and 32, the air departing from opening 48 cannot flow into opening 32 in the manner of the curved broken arrows in FIG. 1, but rather flows upwardly along the outer surface of the curtain 80 (as depicted in FIG. 1), to thaw and dry the curtain, and then flows out into the ambient air. After about 30 to 60 minutes the cover will be free of frost and the curtain can be returned to its housing 70. The air coming out of the refrigerated duct will be under about 45° F., but it will rise rapidly and the defrost will be terminated shortly when the usual 45° F. setting of the termination control 98 is reached. The red indicator light will go out.

F. When the cover is returned to its housing, toggle switch 162 is turned to "On" which will turn on the yellow indicator light, indicating the anti-sweat heaters are on. To obtain maximum energy savings operation, the anti-sweat heaters are connected to the anti-sweat control 152. This control allows only the required amount of energy to be used by the anit-sweat heaters to keep off condensation. Percent of energy used will vary from 100% at 65% R.H. to 0% at 20% R.H.

G. During the time the cover is retracted, if the cabinet should require a defrost, the control 150 will put the cabinet into defrost automatically. The red indicator light will be on telling the store personnel the warm temperature in the cabinet is due to the defrost mode and not a malfunction of the refrigeration system. When the cabinet goes into a defrost, defrost relay 164 de-energizes all the anti-sweat heaters 168 and optionally energizes heater 166 in front of the evaporator coil. This diversion of heat is done only when it is necessary to shorten the defrost period to protect the product from deteriorating.

Those in the art, after contemplating the preferred embodiments of the invention set forth herein, may visualize variations to be made in the control circuitry to suit particular installations. Thus, the invention is intended to be limited by the attached claims and the structures equivalent to those defined therein, rather than to the specific illustrative embodiments described in detail herein.

The embodiments of the invention in which an exclusive property or privilege is claimed are defined as follows:

1. An open front, multiple curtain refrigerated display case having a top, a bottom, a rear, a front side, and an access opening in said front side communicating a storage and display space within the cabinet with the ambient atmosphere, at least two air outlets, an inner one and an adjacent one, extending across the upper edge of said access opening; and corresponding inner and adjacent air inlets extending across the opposite lower edge of said access opening; an inner conduit extending from said inner inlet, around the bottom, back and top of said cabinet, to said inner outlet; an adjacent conduit extending from said adjacent inlet around said cabinet to said adjacent outlet; refrigeration coil in said inner conduit; a plurality of refrigerated-air, circulating fans in said inner conduit to propel air from said inner inlet, across said coil, to said inner outlet, and across said access opening to said inner inlet as a refrigerated air curtain; a plurality of guard-air, circulating fans in said adjacent conduit to propel air in said adjacent conduit, to said adjacent outlet, and across said access opening to said adjacent inlet as a guard air curtain parallel to said refrigerated air curtain; the improvement comprising, in combination with the above:

a flexible, retractable, roll-down night curtain having one end mounted to said case between said inner and adjacent inlets and having a second end which is free; said night curtain being extensible from a rolled retracted condition between said inlets to an elevated unrolled position extending across said access opening between said refrigerated air curtain and said guard air curtain with said free end thereof being secured between said inner and adjacent outlets when extended, to form a closure between the refrigerated air curtain and the guard air curtain, whereby continued operation of said case causes frost and ice to form on and about said night curtain; securing means between said outlets cooperative with said night curtain free end for holding said night curtain in said extended condition; said guard air circulating fans being operable to propel defrost air in said adjacent conduit in the reverse direction relative to the direction of said guard air curtain during normal operation, to melt the frost and ice from said night curtain when in its extended position to allow retraction of said night curtain from said access opening to a retained condition between said inner and adjacent inlets, and said defrost air being caused to flow into said inner inlet for coil defrosting when said night curtain is retracted.

2. The display case in claim 1 including a night curtain housing at the mounted end of said night curtain, for retaining said night curtain in its rolled-up condition.

3. The display case in claim 2 including an upstanding partition between said inner inlet and said adjacent inlet, and wherein said night curtain housing is secured to said partition.

4. The display case in claim 3 wherein said night curtain housing is secured to the top of said partition.

5. The display case in claim 2 wherein said night curtain housing is secured in said adjacent conduit beneath said adjacent inlet to be extensible through said adjacent inlet to extend across said access opening.

6. The display case in claim 1 wherein said night curtain has inherent memory biasing it to rolled-up retracted condition.

7. The display case in claim 1 including a biasing means for rolling up said night curtain.

8. The display case in claim 1 including defrost control means for actuation of said guard air circulating fans in the reverse direction to melt frost and ice from said night curtain when extended, and to melt frost and ice from said coil when said night curtain is not extended.

9. The display case in claim 8 including anti-sweat heaters and including a defrost heater upstream of said coil in said inner conduit, said defrost control means having facility for deactivating said anti-sweat heaters and activating said defrost heater during defrost.

10. An open front, multiple curtain refrigerated display case having a top, a bottom, a rear, a front side, and an access opening in said front side communicating a storage and display space within the cabinet with the ambient atmosphere, at least two air outlets, an inner one and an adjacent one, extending across the upper edge of said access opening; and corresponding inner and adjacent air inlets extending across the opposite lower edge of said access opening; an inner conduit extending from said inner inlet, around the bottom, back and top of said cabinet, to said inner outlet; an adjacent conduit extending from said adjacent inlet around said cabinet to said adjacent outlet; a refrigeration coil in said inner conduit; a plurality of refrigerated-air, circulating fans in said inner conduit to propel refrigerated air from said inner inlet, across said coil, to said inner outlet, and across said access opening to said inner inlet as a refrigerated air curtain; a plurality of guard-air, circulating fans in said adjacent conduit to propel air in said adjacent conduit, to said adjacent outlet, and across said access opening to said adjacent inlet as a guard air curtain parallel to said refrigerated air curtain; the improvement comprising, in combination with the above;

a flexible, retractable, roll-up night curtain having one end mounted between said inner and adjacent inlets and extensible to a position extending across said access opening between said refrigerated air curtain and said guard air curtain; securing means for holding said perforate night curtain in said extended condition; said guard air circulating fans being operable to propel air in one direction for normal operation, and during defrost to propel defrost air in said adjacent conduit in the reverse direction to melt frost and ice from on and about said night curtain when extended, and to flow into said inner inlet for defrosting said coil when said night curtain is not extended.

* * * * *

UNITED STATES PATENT AND TRADEMARK OFFICE

CERTIFICATE OF CORRECTION

PATENT NO. : 4,117,698

DATED : October 3, 1978

INVENTOR(S) : Robert E. Vogel

It is certified that error appears in the above-identified patent and that said Letters Patent are hereby corrected as shown below:

In the Abstract, line 7:
"front" should be ---frost---

Column 1, line 25:
"are" should be ---were---

Column 1, line 27:
"of" should be ---on---

Column 2, line 66:
"case" should be ---space---

Column 3, line 20:
Before "serving" should be ---this one---

Column 3, line 56:
"panel 46' and 46" " should be ---panels 46' and 46"---

Column 4, line 16:
"time" should be ---top---

Column 5, line 25:
"preferably" should be ---preferable---

Column 10, line 19:
"perforate" should be ---impervious---

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*